US005751096A

United States Patent [19]

Lahens

[11] Patent Number: 5,751,096

[45] Date of Patent: May 12, 1998

[54] SPARK PLUG HAVING A PLURALITY OF VERTICAL GROUND ELECTRODES AND A VERTICAL CYLINDRICAL SHAPED CENTER ELECTRODE IN PARALLEL FORMATION FOR USE IN A INTERNAL COMBUSTION ENGINE

[76] Inventor: Albert Lahens, 200-37th St., Union City, N.J. 07087

[21] Appl. No.: 923,710

[22] Filed: Sep. 4, 1997

Related U.S. Application Data

[63] Continuation of Ser. No. 549,922, Oct. 27, 1995, abandoned.

[51] Int. Cl.[6] ..... H01T 13/46

[52] U.S. Cl. ..... 313/141; 313/142; 123/169 EL

[58] Field of Search ..... 313/141, 142, 313/144; 123/169 EL

[56] References Cited

U.S. PATENT DOCUMENTS

| | | | |
|---|---|---|---|
| 1,191,603 | 7/1916 | Loose | 313/141 X |
| 1,538,870 | 5/1925 | Champion | 313/141 X |
| 2,894,162 | 7/1959 | Ignatjev | 313/141 |
| 3,970,885 | 7/1976 | Kasima | 313/141 |
| 4,023,058 | 5/1977 | Lara et al. | 313/141 X |
| 4,268,774 | 5/1981 | Forkum, Jr. | 313/141 |
| 4,401,915 | 8/1983 | Kashiwara | 313/142 |
| 4,851,732 | 7/1989 | Kashiwara et al. | 313/141 |
| 5,497,045 | 3/1996 | Matsutani et al. | 313/141 |
| 5,502,351 | 3/1996 | Katoh et al. | 313/141 |
| 5,502,352 | 3/1996 | Katoh et al. | 313/141 |

FOREIGN PATENT DOCUMENTS

| | | | |
|---|---|---|---|
| 3828805 | 3/1990 | Germany | 313/141 |

*Primary Examiner*—Ashok Patel

[57] ABSTRACT

An improved spark plug having multiple ground electrodes (10) placed around a center electrode (12). Standing vertical ground electrodes are joined at top base of a metal jacket (18). Ground electrodes (10) and center electrode (12) are made of a rigid material.

6 Claims, 4 Drawing Sheets

SPARK PLUG HAVING A PLURALITY OF VERTICAL GROUND ELECTRODES AND A VERTICAL CYLINDRICAL SHAPED CENTER ELECTRODE IN PARALLEL FORMATION FOR USE IN A INTERNAL COMBUSTION ENGINE

This application is a continuation of U.S. patent application Ser. No. 08/549,922 filed Oct. 27, 1995, now abandoned.

BACKGROUND

1. Field of Invention

This invention relates to spark plugs, specifically to such spark plugs which are used in internal combustion engines.

2. Description of Prior Art

U.S. Pat. No. 4,401,915 offers no real improvement over the conventional, overhead, ground electrode. This patent claims that having a slit, or holes along the ground electrode would minimize interference of the overhead, ground electrode. In effect this spark plug does little to improve combustion efficiency. The reason for this is that this spark plug still relies on an archaic design. This design has the inherent defect of having the ground electrode interfere with maximum spark propagation. Despite this spark plug's many variations all have the same inherent defect of a bulky, overhead, ground electrode.

U.S. Pat. No. 3,970,885 is the same conventional, overhead ground electrode. In this spark plug the ground electrode is modified. These modifications include a kerf, groove, depression projection, or the like at the discharge area. Although the ground electrode is modified in many forms, it still suffers from the interference of the overhead, ground electrode. Hence, this spark plug gives no improvement over other conventional, overhead, ground electrode spark plugs.

U.S. Pat. No. 4,023,058 is another modification of the old, antiquated, overhead, ground electrode spark plug. In this spark plug the overhead ground electrode has a port, or hole which extends to the other side. Despite this modification the cumbersome overhead ground electrode still interferes with the combustion process. The intrinsic defects of the overhead ground electrode spark plug are still not corrected with this modification. Maximum spark plug propagation is simply not possible with the overhead ground electrode.

A similar design to U.S. Pat. No. 4,268,774 is U.S. Pat. No. 2,894,162. In this spark plug, the split ends of the overhead ground electrode run parallel to each other. Despite the split end ground electrode, this spark plug is a mildly different reiteration of the old, conventional overhead ground electrode. The fact that the overhead ground electrode is split at the ends does not necessarily increase spark exposure. Incoming current can only jump from the center electrode to one of the split ground electrode tips at a time. This is due to the fact that current does not equally split into smaller branches. This is why splitting the ground electrode will not improve the combustion efficiency.

U.S. Pat. No. 1,538,870 offers a different variation of the old, overhead ground electrode configuration. This spark plug differentiates itself by notching the ground electrode tip. Despite the fact that this spark plug comes in many variations, all of the variations have "bent" ground electrodes. Increasing the number of notches on the ground electrode does not increase the spark exposure in the combustion chamber. The ground electrode only receives current from the center electrode. The fact that the ground electrode has notches will not cause the incoming current to spread out and increase spark exposure. This is due to the fact that current cannot split itself equally and touch multiple points on the ground electrode at the same time. In effect this spark plug offers no real improvement over the old conventional overhead ground electrode.

All gasoline powered vehicles use spark plugs. In most engines the spark plug is located at the top of the cylinder. When the plug ignites the air/fuel mixture it causes expanding gases to push the piston down. As a result the engine is able to deliver power to the wheels. Modern internal combustion engines are more efficient than engines produced twenty to thirty years ago. Unfortunately, the same cannot be said about spark plugs.

For the most part the spark plug has remained relatively unchanged. The basic configuration of a center electrode covered by an overhead ground electrode is still in wide use today.

Recent designs, however, offer a new twist of the same old configuration. U.S. Pat. No. 4,268,774 to Splitfire Inc. discloses a new design to the overhead ground electrode. By splitting the ground electrode at the tip a V shape design emerges. This new configuration is suppose to expose more of the flame kernel to the air/fuel mixture. As a result this spark plug should in theory give increases in gas mileage and engine power. Despite these claims the overhead ground electrode still interferes with the flame kernel. This is due to the fact that this design is based on the old configuration. In this particular spark plug the current does not jump between the V groove. It tends to jump to the curved portion of the overhead ground electrode. So any beneficial effect is minimized by this inherent defect. In retrospect this particular spark plug suffers from a number of disadvantages:

(a) The center electrode only fires, or transmits current through only one side. As a result the center electrode will wear out faster giving the spark plug a shorter service life.

(b) Overhead ground electrode prevents the flame kernel from being exposed to fullest extent possible.

(c) This spark plug needs to be calibrated for spark gap.

(d) It cost more to make this spark plug because of modified ground electrode.

OBJECTS AND ADVANTAGES

Accordingly, several objects and advantages of my invention are:

(a) to provide ease of installation because no calibration is needed for spark plugs.

(b) to provide a longer service life by using multiple ground electrodes.

(c) to provide an increase in engine efficiency by exposing a relatively large flame kernel to air/fuel mixture.

Further objects and advantages of my invention will become apparent from a consideration of the drawings and ensuing description.

DRAWING FIGURES

Reference Numerals In Drawings

| | |
|---|---|
| 10 ground electrode | 16 ceramic jacket |
| 12 center electrode | 18 metal jacket |
| 14 threads | 20 center electrode core |

DESCRIPTION

FIGS. 1 to 4

Figure 1:
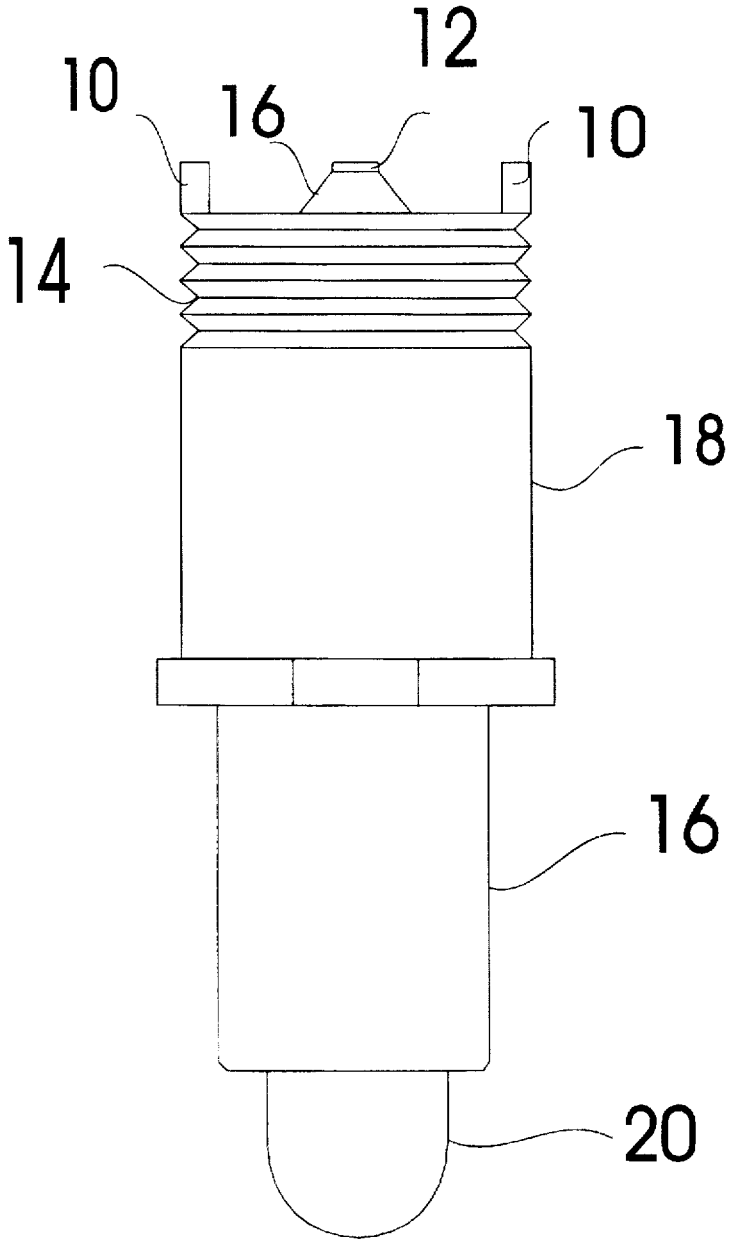
FIG. 1 shows an enlarged frontal view of the spark plug with the ground electrodes placed at equal distances from the center electrode.

A typical embodiment of the present invention is illustrated in FIG. 1. FIG. 1 shows the front view of entire spark plug. At the top of spark plug a center electrode 12 is between vertical ground electrodes 10. Ground electrode 10 is joined at top base of metal jacket 18. Ground electrode 10 stands vertical and is made of a rigid material. Threads 14 of spark plug are used to screw in spark plug into engine block. A ceramic jacket 16 is used to prevent current flowing through spark plug from jumping prematurely. A center electrode core 20 is where current enters spark plug.

Figure 2:
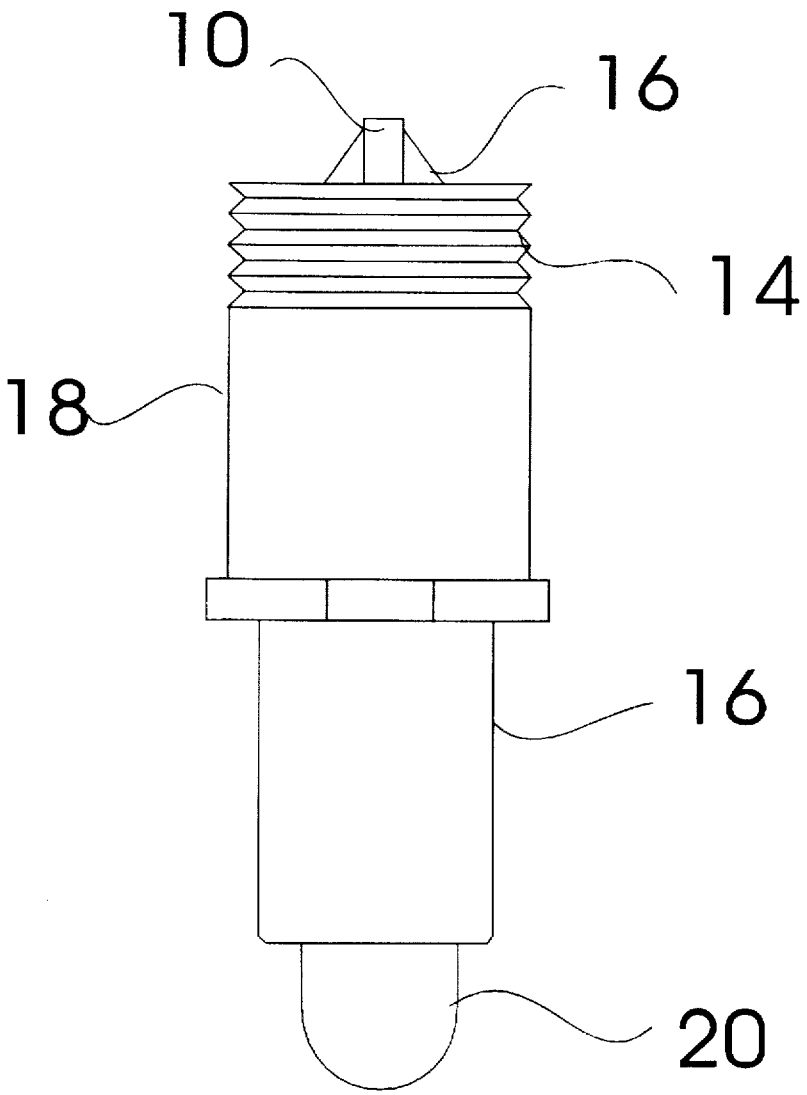
FIG. 2 shows an enlarged side view of the spark plug displaying a ground electrode at the top of the plug.

FIG. 2 displays a side view of the spark plug. From side view ground electrode 10 can be seen. This view shows ground electrode 10 standing vertical.

Figure 3:
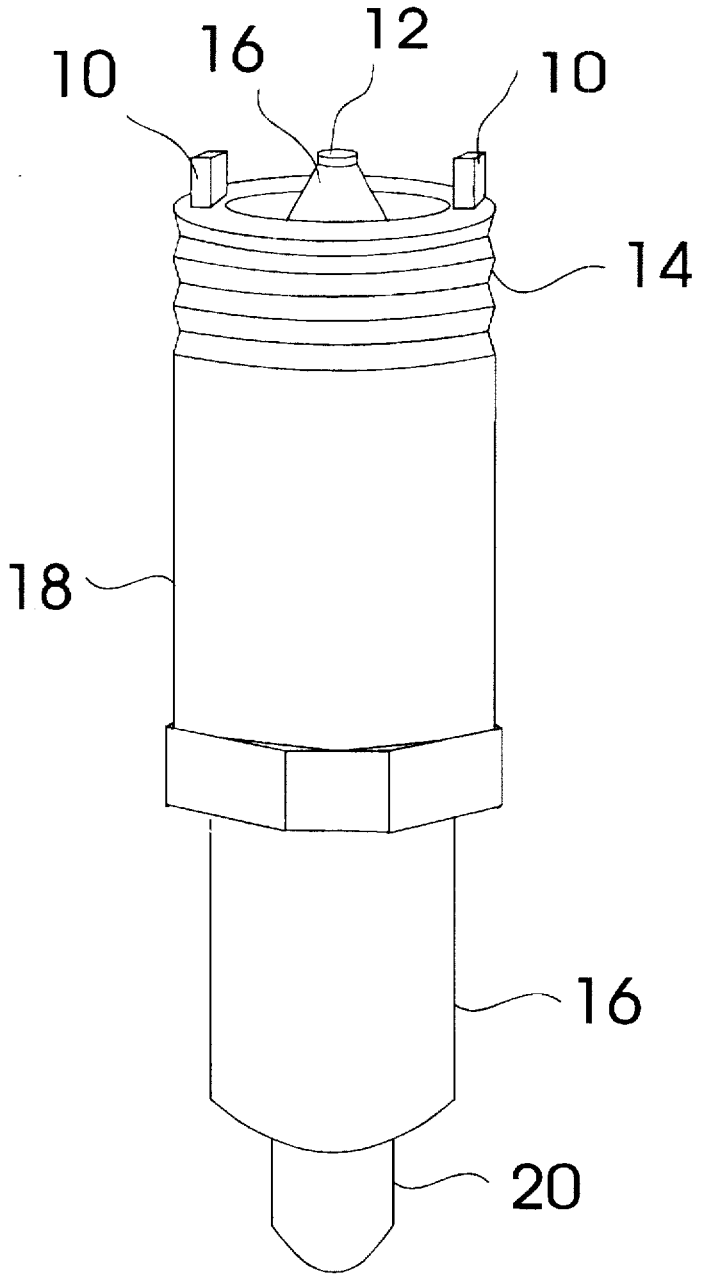
FIG. 3 shows an enlarged perspective view of the spark plug showing the center, and ground electrodes in their relative positions.

FIG. 3 shows an enlarged perspective view of entire spark plug. Here ground electrodes 10 are seen joined at top base of metal jacket 18. Center electrode 12 is at center of spark plug. This view also shows ground electrode 10 standing vertical. FIG. 3 shows ground electrode 10 is joined at top base of metal jacket 18.

Figure 4:
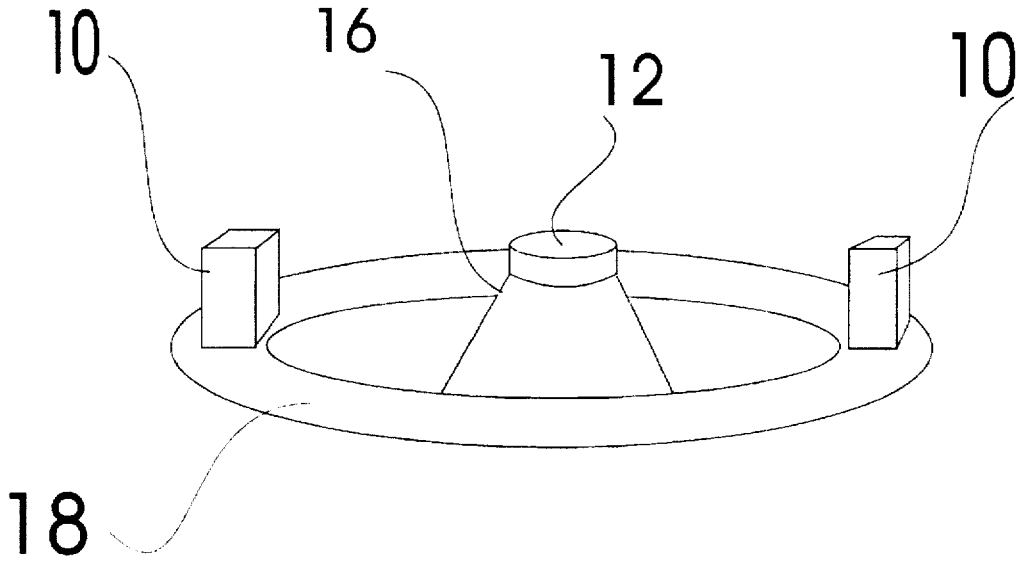
FIG. 4 shows an enlarged perspective view of the improved top portion of the spark plug separated from the rest of the spark plug.

FIG. 4 shows the improved top portion of the spark plug separated from the rest of the plug. The top portion shows the ground electrodes 10 placed around center electrode 12. This view shows ground electrodes standing vertical.

OPERATION

FIGS. 1, 2, 3, 4

The drawings of FIG. 1, 2, 3, and 4 show components of a spark plug. As current enters the spark plug it travels straight through the center electrode core 20. A ceramic jacket 16 surrounds center electrode core 20. Ceramic jacket is used to prevent current from escaping. When current reaches center electrode 12 it jumps laterally to a ground electrode 10. In the act of jumping the current creates a large flame kernel, or spark. This flame kernel is what ignites air/fuel mixture inside a cylinder.

Main function of ground electrode 10 is to provide a ground or negative terminal for incoming current. The vertical design of ground electrode 10 permits spark to be completely exposed to air/fuel mixture. Another function of ground electrode 10 is to provide a longer service life. This is accomplished by having multiple ground electrodes 10 placed around center electrode 12. This gives center electrode 12 the ability to transmit current from different sides.

Primary function of center electrode 12 is to transmit current. Acting as a positive terminal current immediately jumps laterally to negative terminal, or ground electrode 10. When center electrode 12 begins to wear out on a side current automatically switches to side that is not worn out.

SUMMARY, RAMIFICATIONS, AND SCOPE

Accordingly, the reader will see that this multiple electrode spark plug offers many advantages.

no calibration for spark gap is needed to install spark plug into engine.

provides a longer service life by using multiple ground electrodes.

design permits complete unobstructed exposure of large flame kernel; thus increasing engine efficiency.

Although the description above accommodates many specificities, these should not be interpreted as limitations on the scope of the invention, but rather as an illustration of one preferred embodiment thereof. Many other variations are possible. For example, this spark plug can easily be modified to include a single or a multiple set of the vertical ground electrodes. The appearance of ground electrodes can also be modified. The ground electrodes could easily be modified in shape to be circular, triangular, rectangular, etc.

The shape of the center electrode can be changed in appearance. For example, instead of having a circular shape the center electrode can be altered to shapes such as a square, triangular, oval etc. The center and ground electrodes can be extended to position them closer to the air/fuel mixture inside the cylinder. A variety of materials can be used to make the ground and center electrodes; they include steel, iron, titanium, alloys, etc.

Thus the scope of the invention should be determined by the appended claims and their legal equivalents, rather than by the examples given.

I claim:

1. A spark plug comprising of a plurality of vertical ground electrodes and a ceramic covered single center electrode with free end exposed wherein, said free end is of a cylindrical design extending in a longitudinal manner, such that, a circular edge forms around entire circumference of said free end of said center electrode tip, such that, top of said center electrode forms a 90 degree angle with the cylindrical side of said center electrode, wherein said top of said center electrode points in a parallel manner, in the same longitudinal direction of said ground electrode tip face, such that, said free end being free of any prongs.

2. The spark plug of claim 1 wherein said ground electrodes maintain a physical parallel posture with respect to said center electrode.

3. The spark plug of claim 1 wherein said center electrode extends in a cylindrical shape lengthwise.

4. In a spark plug comprising an insulated single center electrode and a plurality of vertical ground electrodes characterized in that said center electrode with free end exposed is of a cylindrical design extending in a lineal manner, such that, a round edge forms around entire circumference of said free end of said center electrode tip, such that, top of said center electrode forms a right angle with the cylindrical side of said center electrode, wherein, said top of said center electrode points in a parallel manner, in the same longitudinal direction of said ground electrode tip face, such that, said free end being free of any prongs.

5. The spark plug of claim 4 wherein said ground electrodes maintain a physical parallel posture with respect to said center electrode.

6. The spark plug of claim 4 wherein said center electrode extends in a cylindrical shape lengthwise.

* * * * *